United States Patent [19]

Stapleton et al.

[11] 4,138,605

[45] Feb. 6, 1979

[54] THERMAL PRINTING HEAD

[75] Inventors: Earl W. Stapleton; Patricia A. McLaughlin; Jerry E. Turnbaugh, all of Portland, Oreg.

[73] Assignee: Tektronix, Inc., Beaverton, Oreg.

[21] Appl. No.: 770,721

[22] Filed: Feb. 22, 1977

Related U.S. Application Data

[60] Division of Ser. No. 722,989, Sep. 13, 1976, Pat. No. 4,037,315, which is a continuation of Ser. No. 572,499, Apr. 28, 1975, abandoned, which is a division of Ser. No. 383,955, Jul. 30, 1973, Pat. No. 3,903,393.

[51] Int. Cl.[2] ..... H05B 1/00

[52] U.S. Cl. ..... 219/216; 219/543; 346/76 R

[58] Field of Search ..... 219/216, 543, 121 LM; 346/76 R

[56] References Cited

U.S. PATENT DOCUMENTS

| | | | |
|---|---|---|---|
| 3,649,801 | 3/1972 | Cardell et al. | 338/195 X |
| 3,684,858 | 8/1972 | Buck | 219/543 |
| 3,768,157 | 10/1973 | Buie | 219/121 LM |
| 3,913,091 | 10/1975 | Aizawa et al. | 219/216 |
| 3,973,106 | 8/1976 | Ura | 219/216 |
| 3,989,131 | 11/1976 | Knirsch et al. | 219/216 X |
| 4,032,881 | 6/1977 | Singleton | 338/195 |

*Primary Examiner*—C. L. Albritton
*Attorney, Agent, or Firm*—Adrian J. La Rue

[57] ABSTRACT

A row of thick-film resistors connected by thick-film conductors on a ceramic substrate are suitably powered to form a thermal printing head. Thermally-sensitive paper is placed in intimate contact with the resistors, some of which are heated to a temperature sufficient to cause a color change in the paper to thereby produce a corresponding array of dots. The paper is moved across the printing head in incremental steps, forming other arrays of dots. The dots combine to form alphanumeric characters.

5 Claims, 8 Drawing Figures

THERMAL PRINTING HEAD

This is a division of Ser. No. 722,989, Sept. 13, 1976, U.S. Pat. No. 4,037,315, which is a continuation of Ser. No. 572,499, Apr. 28, 1975, abandoned, which is a division of Ser. No. 383,955, July 30, 1973, U.S. Pat. No. 3,903,393.

BACKGROUND OF THE INVENTION

This invention relates to a printing head and more particularly to a thermal printing head.

Thick-film thermal printing heads in use today have resistive members secured on a ceramic substrate which are connected to a common conductive member and respective conductive members, both being also secured on such substrate. These thick-film printing heads use a substrate that has a relatively high thermal conductivity which causes a high proportion of available heat to be wasted and not transferred to the paper. A layer of insulating material can be applied onto the substrate under the resistors to impede the heat loss, but this is an extra processing step which adds complexity and cost.

The longitudinal configuration of normally-printed thick-film resistive members is typically undulating such that the center area, where the highest concentration of heat is located, is disposed lower than areas on each side thereof, thereby preventing proper printing on the thermally-sensitive paper.

SUMMARY OF THE INVENTION

The present invention is directed to a thermal printing head which includes a substrate having low thermal conductivity to reduce heat loss, so that a relatively large proportion of the heat generated by the resistive members is available to cause the thermally-sensitive paper to change color and formulate information thereon. The configuration of the resistive members is such that a substantially planar top surface is provided by each resistive member to provide a large surface area for engagement by the thermally-sensitive paper to ensure the discoloration thereof via the heated resistive members. A heat sink is provided on the substrate to prevent overheating of the substrate which prevents general smearing of the paper. The thickness of the conductive strips is typically less and the thickness of the resistive members is also typically less than is used in conventional thick-film devices to ensure proper paper contact. The printing resistors can be formed by laser cutting a continuous resistive bar between conductive paths to form individual resistive members or they can be screen printed to form closely adjacent resistive members interconnected by necked-down sections.

An object of the present invention is to provide a thermal printing head which uses a substrate of low thermal conductivity.

Another object of the present invention is the provision of a thermal printing head which has positive paper contact by use of relatively resistive members.

A further object of this invention is to provide a thermal printing head wherein the paper-engaging surfaces of the resistive members are substantially flat to provide large areas of contact for the thermally-sensitive paper.

An additional object of the present invention is to provide a thermal printing head having resistive members which have an optimum configuration for enabling the thermally-sensitive paper to engage the highest temparative portion of the resistors to cause a maximum of color change in the paper.

Still another object of this invention is the provision of a thermal printing head having a heat sink to prevent the substrate of the printing head from overheating and thereby prevent smearing of the thermally-sensitive paper.

A still further object of the present invention in one embodiment is the use of a laser to cut through the continuous bar of resistive material to separate it into discrete resistive members.

A still additional object of this invention in another embodiment is the provision of individually-separated resistive members screen printed onto the conductive members which eliminates the laser cutting requirement.

BRIEF DESCRIPTION OF DRAWINGS

Other objects and advantages of the present invention will be apparent from the detailed description of preferred embodiments thereof and from the attached drawings of which.

DETAILED DESCRIPTION OF THE INVENTION

Figure 3:
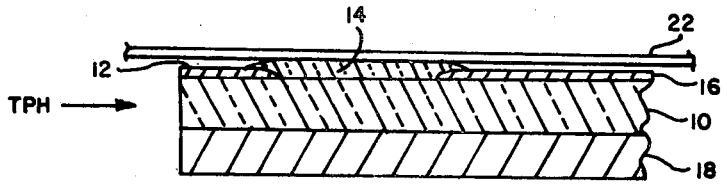
FIGS. 3 and 4 are cross-sectional views taken along lines 3—3 and 4—4 of FIG. 1.
Figure 4:
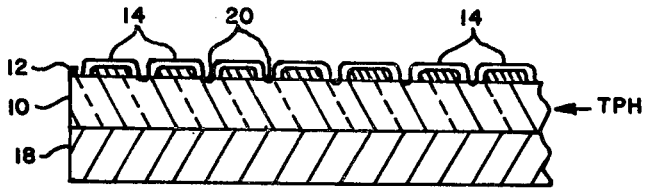
Figure 1:
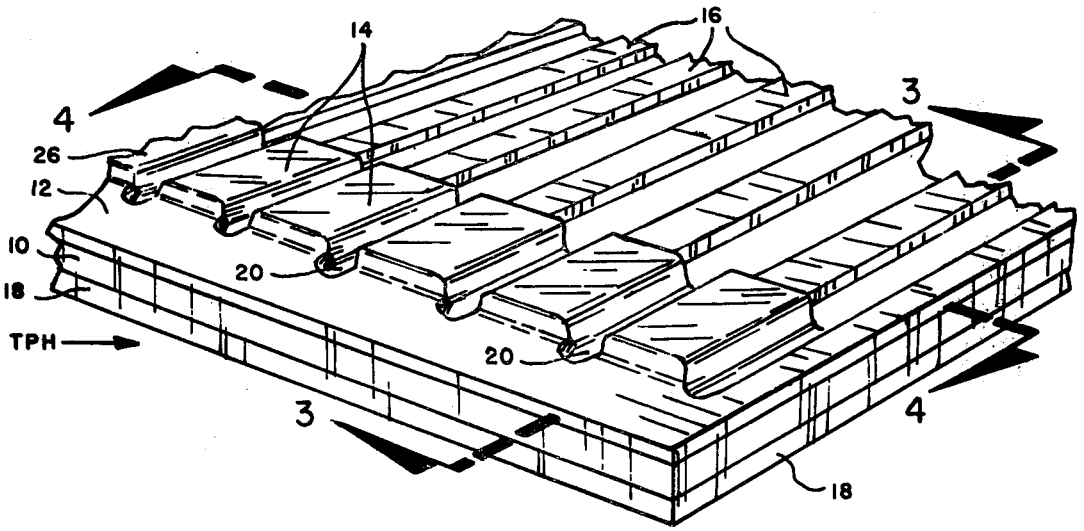
FIG. 1 is a part perspective view of one embodiment of a thermal printing head of this invention.

Referring to FIGS. 1 - 4, a thermal printing head TPH is illustrated which comprises a ceramic substrate 10, common conductive members 12, resistive members 14, conductive members 16 and heat sink 18.

Ceramic substrate 10 is preferably composed of a material having low thermal conductivity, and the use of forsterite, which is a composition of principally magnesium oxide and silicon oxide, has provided excellent operating results; however, any material of comparable or lower thermal conductivity capable of withstanding thick-film processing can be used. The use of lower thermally conductive material in the substrate reduces power required by reducing heat loss. Conductive members 12 and 16 are screen printed with gold conductive paste onto a surface of substrate 10 in accordance with a predetermined pattern as shown so that the inner ends of conductive members 16 are disposed at right angles to conductive member 12 and spaced therefrom. The substrate and paste are fired in an oven at the proper temperature to fix the paste as conductive members.

A continuous bar of resistive paste is screen printed across conductive members 12 and 16 so that it fills the spaces between the inner ends of conductive members 16 and conductive member 12 as well as lapping over and onto small areas of these conductive members as shown in FIG. 3. The resistive paste is a conventional rheology ruthenate thick-film resistor paste. Firing fixes the resistive paste on the substrate so that it extends above the conductive members 12 and 16 in a ratio of about 2:1. The thickness of the conductive members 12 and 16 is about one-half the thickness of conventional thick-film conductive members so that the thickness of conductive members 12 and 16 and resistive members 14 is quite thin compared to corresponding conductive members and resistive members of existing thermal printing heads. The conductive members can be thin because a glass-free noble-metal conductive ink capable of bonding directly to the substrate can be used.

After the resistive paste has been fixed, a conventional YAG laser trimmer is used to cut the resistive bar between the conductive members 16 as shown at 20 to separate the resistive bar into discrete resistive members 14 having a substantially rectangular configuration connected between common conductive member 12 and respective conductive members 16 so that when current is conducted along a selected conductive member 16 in accordance with well known circuit means, which need not be disclosed for the understanding of the present invention, the resistive member 14 connected thereto will be heated and the heat generated thereby will discolor thermally-sensitive paper 22 as it is moved along the thermal printing head to mark indicia thereon.

Use of the laser enables a controlled cut to be made such that the continuous resistive bar is cut into discrete resistive members, the laser beam cuts slightly into the substrate to provide better thermal isolation between the discrete resistive members, a planar top surface of the resistive members is attained which provides greater paper contact area and this provides greater dot area on the thermally sensitive paper thereby providing better resolution of the indicia and closer spacing between the discrete resistive members is achieved by the laser cutting.

The top surfaces of the resistive members 14 are substantially flat to provide large areas for engagement by the thermally sensitive paper as well as to enable the paper to engage the area of greatest heat concentration of the resistive members to discolor same. Thus, the paper contacts the resistive members over substantially all of their paper-engaging surfaces which provides close dot spacing and large dots.

The heat sink 18 is preferably made of aluminum or other suitable heat sink material in order to prevent overheating of the substrae material thereby preventing smearing of the thermally sensitive paper.

Turning now to FIGS. 5–8, an alternative embodiment is shown in which thermal printing head TPHa is similar to thermal printing head TPH of FIGS. 1–4, except that resistive members **14*a* are diamond-shaped such that contact of a resistive member 14*a* to adjacent resistive members 14*a* is minimized via necked-down sections 24**.

The necked-down sections 24 provide high resistance paths so that each resistive member acts independently. The construction and method of making the thermal printing head of FIGS. 5–8 is the same as that of FIGS. 1–4 with the exception of the resistive members which are made separate initially and so need not be separated subsequently.

As shown, in FIGS. 5–8, the resistive members **14*a* have a substantially flat top surface defining the paper-engaging surface for engagement by the thermally-sensitive paper 22*a*** to provide close dot spacing and large dots.

Figure 2:
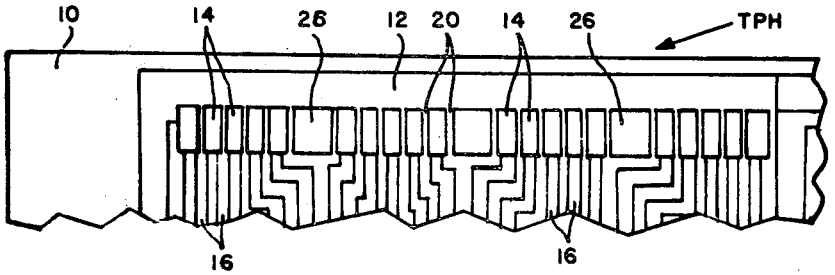
FIG. 2 is a top plan view of part of the thermal printing head of FIG. 1.
Figure 7:
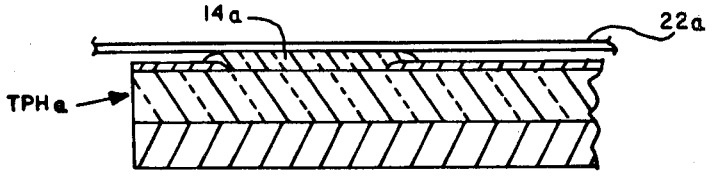
FIGS. 7 and 8 are cross-sectional views taken along lines 7—7 and 8—8 of FIG. 5.
Figure 8:
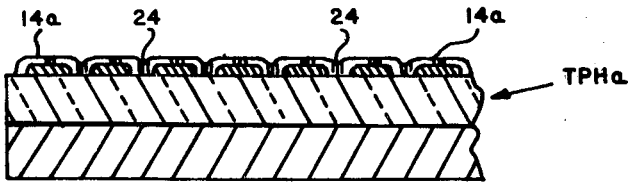
Figure 5:
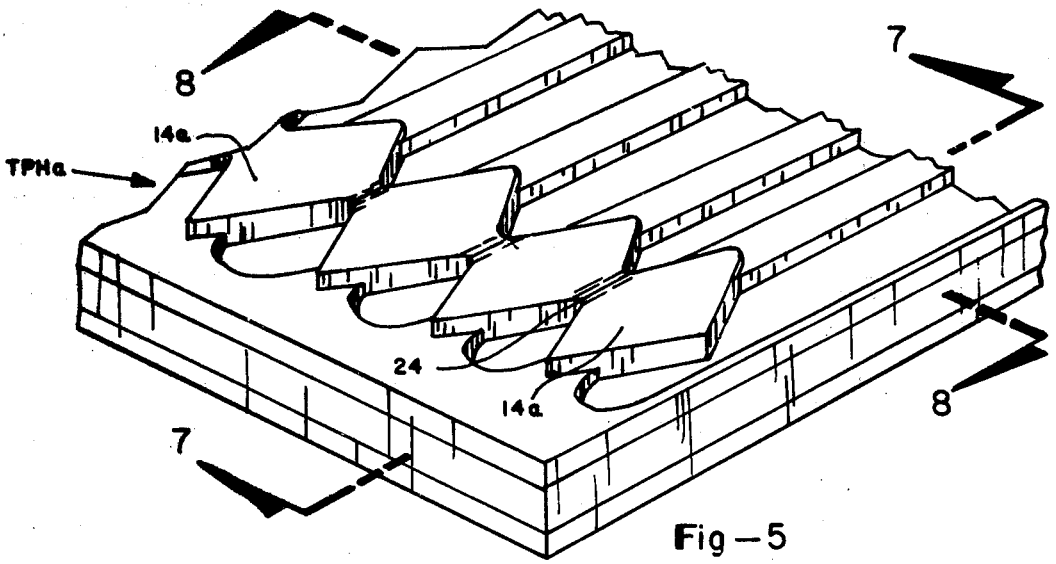
FIG. 5 is a part perspective view of another embodiment of the thermal printing head.
Figure 6:
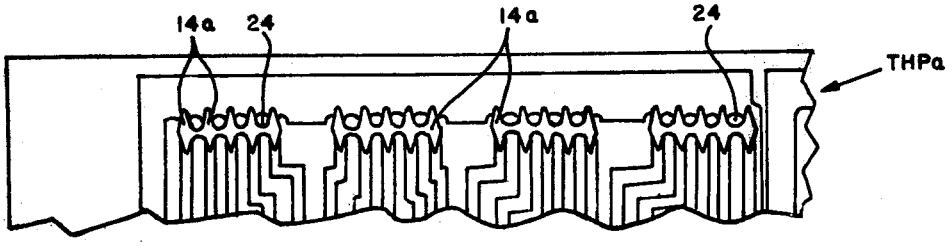
FIG. 6 is a top plan view of part of the thermal printing head of FIG. 5.

The resistive members can be formed into clusters as shown in FIG. 2 with a discrete resistive member 26 between the clusters due to the continuous resistive bar being cut into discrete resistive members or the clusters of resistive members can be in separate clusters of a continuous resistive bar with no resistive material therebetween as shown in FIG. 6.

The advantages of this invention include simplified processing, lower power usage, improved resolution due to large and substantially flat paper-engaging surfaces of the resistive members and ratio of thickness of resistive members to conductive members being large.

Although the present invention has been described with respect to specific details of certain embodiments thereof, it is not intended that such details be limitations upon the scope of the invention except insofar as set forth in the following claims.

The invention is claimed in accordance with the following:

1. A thermal printing head for thermally marking a thermally-sensitive record material comprising:

a substrate member of low thermal-conductivity material having at least one plane surface;

a conductive member secured onto and extending along said plane surface of said substrate member;

conductive means secured onto and extending along said plane surface of said substrate member and having ends spaced from said conductive member; and resistive means deposited onto said plane surface of said substrate member and into electrical engagement with said conductive member and respective ends of said conductive means and cutting through said resistive means between adjacent ones of said conductive means thereby forming discrete resistive members connected between said common conductive member and respective ends of said conductive means, said discrete resistive members having printing surfaces that are located above said conductive member and said conductive means whereby the passage of electrical current through a selected one of said discrete resistive members via said conductive means and said common conductive member will produce a temperature rise of sufficient magnitude to produce a mark on thermally-sensitive record material in engagement therewith.

2. A thermal printing head according to claim 1 wherein said resistive members have substantially flat surfaces.

3. A thermal printing head according to claim 1 wherein said resistive members have a substantially rectangular configuration.

4. A thermal printing head according to claim 1 wherein said resistive members have a thickness of about twice the thickness of said conductive member and said conductive means.

5. A thermal printing head according to claim 1 wherein said cutting is done by laser beam means.

* * * * *